US008800519B2

(12) United States Patent
Dorn et al.

(10) Patent No.: US 8,800,519 B2
(45) Date of Patent: Aug. 12, 2014

(54) ROLLER TAPPET

(71) Applicant: Schaeffler Technologies AG & Co. KG, Herzogenaurach (DE)

(72) Inventors: Stefan Dorn, Hollfeld (DE); Norbert Geyer, Hochstadt (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 13/760,199

(22) Filed: Feb. 6, 2013

(65) Prior Publication Data

US 2013/0213333 A1 Aug. 22, 2013

(30) Foreign Application Priority Data

Feb. 20, 2012 (DE) ..... 10 2012 202 566

(51) Int. Cl.
*F01L 1/14* (2006.01)

(52) U.S. Cl.
USPC ..... 123/90.48

(58) Field of Classification Search
CPC ..... F01L 1/12; F01L 1/14; F01L 13/0031; F01L 1/2405; F01L 1/245
USPC ..... 123/90.6, 90.39, 90.16, 90.52, 90.55, 123/90.59, 90.48
See application file for complete search history.

(56) References Cited

U.S. PATENT DOCUMENTS 7,878,169 B2 * 2/2011 Brinks ..... 123/90.48

FOREIGN PATENT DOCUMENTS

DE 102010022318 12/2011

* cited by examiner

*Primary Examiner* — Zelalem Eshete
(74) *Attorney, Agent, or Firm* — Volpe and Koenig, P.C.

(57) ABSTRACT

A roller tappet having a housing near whose drive side front end, two diametrically opposing flats receding from an outer wall of the housing are arranged, each of the two flats having a seat with a U-shape open in a direction towards the drive side front end. A pin is mounted in the seats, a roller serving as a run-on surface of a periodic stroke producer extends on said pin, and a support for a tappet follower element is seated axially under the roller near a driven side front end of the roller tappet. A retention element is provided for the pin in an axial direction of the pin and a retention element in the seats of the pin is provided for preventing the pin from exiting axially out of the housing, and these two retention elements are united.

7 Claims, 1 Drawing Sheet

ROLLER TAPPET

INCORPORATION BY REFERENCE

The following documents are incorporated herein by reference as if fully set forth: German Patent Application No.: DE 102012202566.9, filed Feb. 20, 2012.

BACKGROUND

The invention concerns a roller tappet comprising a housing near whose drive side front end, two diametrically opposing flats receding from an outer wall of the housing are arranged, each of said two flats comprising a seat with a U-shape open in a direction towards the drive side front end, a pin being mounted in said seats, a roller serving as a run-on surface of a periodic stroke producer extending on said pin, a support for a tappet follower element being seated axially under the roller near a driven side front end of the roller tappet, a retention means in an axial direction of the pin and a retention means in the seats for the pin being provided for preventing the pin from exiting axially out of the housing.

A roller tappet of the above-cited type, for example for a high pressure fuel pump of a quality or quantity regulated type internal combustion engine is described in DE 10 2010 022 318 A1. A retention means for the pin for preventing its exit out of the housing is created through its encompassment over more than 180° in the seats of the flats. At the same time, the pin runs with its front ends on inner sides of an upper belt zone of the housing so that a further retention means is created (s. FIG. 4).

A drawback of the aforesaid configuration is that, during snapping-in of the pin into its seat, a plastic deformation of its only thin-walled sheet material, as well as surface damage, can occur. Depending on the circumstances, if the encompassment of the pin is inadequate, this type of securing can also come apart. Moreover, it is to be noted that when the pin runs with its front ends on the inner sides of the upper belt, wear can likewise occur so that, in the final analysis, it is not possible to adjust the axial lash of the pin.

SUMMARY

The invention addresses this problem by the fact that two retention means are united and, according to a first, particularly preferred embodiment of the invention, for forming the retention means, the pin comprises a central section of a large diameter that carries the roller and two end annular shoulders of a diameter smaller than that of the central section that are seated in the seats, so that an intermediate step is created between the central section and each respective annular shoulder, lateral arms of the seats extending in axial direction of the tappet are smooth-walled and straight, while at the same time, a finger protrudes from near the corresponding flat into the interior of the tappet from an upper transverse side of a window of the housing so as to run to a point immediately in front of/on the corresponding annular shoulder and the annular step of the pin.

In this way, the invention dispenses with the prior art "separated" securing means for the pin and the aforesaid wear as well as the risk of deformation of the tappet material in the region of the seat are minimized or even excluded.

The finger which is simple to attach and projects preferably integrally from the window, is cut without chip removal and bent slightly in direction of the tappet interior. This finger thus fulfills a double function for the pin, as an axial securing of the pin and at the same time as a displacement limitation of the pin against exiting out of the housing.

It is understood that the united retention means can be configured such that the pin still possesses a slight movability in its axial direction as well as in a longitudinal direction of the housing.

According to a further development of the invention, it is proposed to configure the outer wall of the housing between the upper transverse sides of the two windows comprising the fingers, together with the drive side front end, in form of a smooth-walled, closed continuous ring. Moreover, an optimal junction is created for the finger projecting onto the pin, which finger may alternatively also project inwards from a side wall of the respective window and/or be made as a separate component.

The bridge member comprising the support for the tappet follower element is made preferably, but not exclusively, as a separate, simply punched sheet metal plate and comprises on its underside an integrally configured support for the tappet follower element (gas exchange valve, tappet push rod, pump piston).

The receding flats with the seats are preferably connected integrally to the housing and are generated, for example, by a rudimentary stamping of a wall region of the housing radially in inward direction.

The roller tappet is preferably used as a cam follower or eccentric follower for or in a high pressure pump, in a direct or indirect valve train of an internal combustion engine, or in an axial or radial piston engine, or in a pump of this type.

BRIEF DESCRIPTION OF THE DRAWINGS

The invention will now be described more closely with reference to the appended drawing. The figures show.

DETAILED DESCRIPTION OF THE PREFERRED EMBODIMENTS

Figure 1:
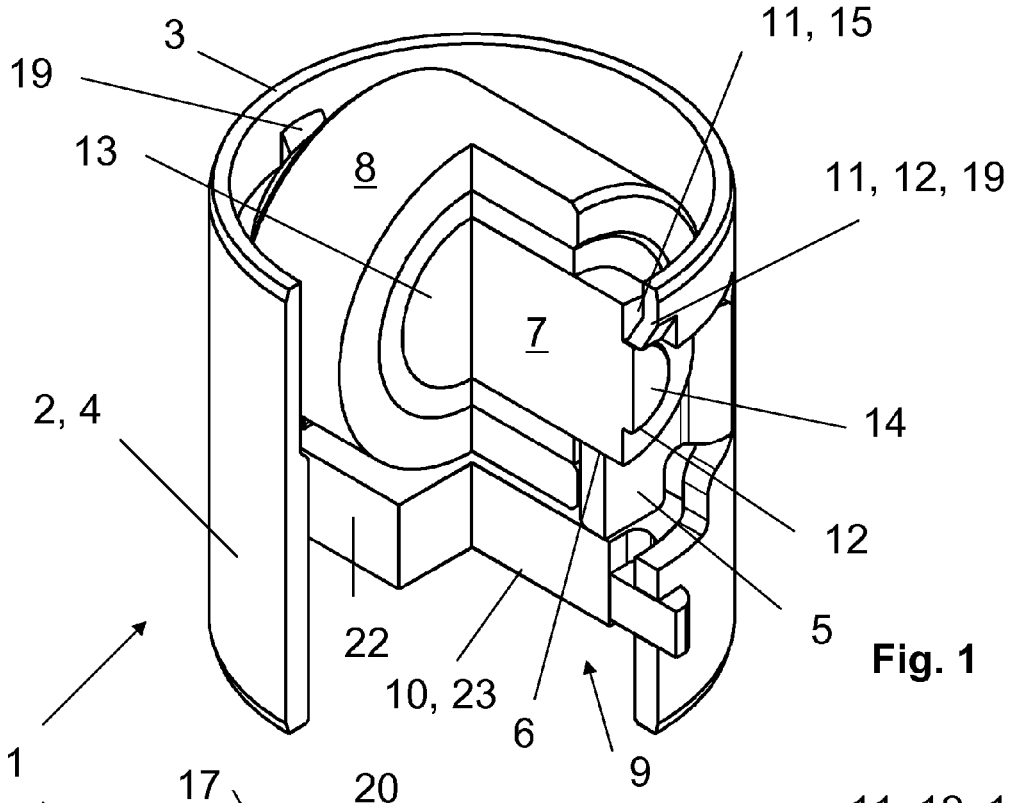
FIG. 1 a three dimensional view of a roller tappet.
Figure 2:
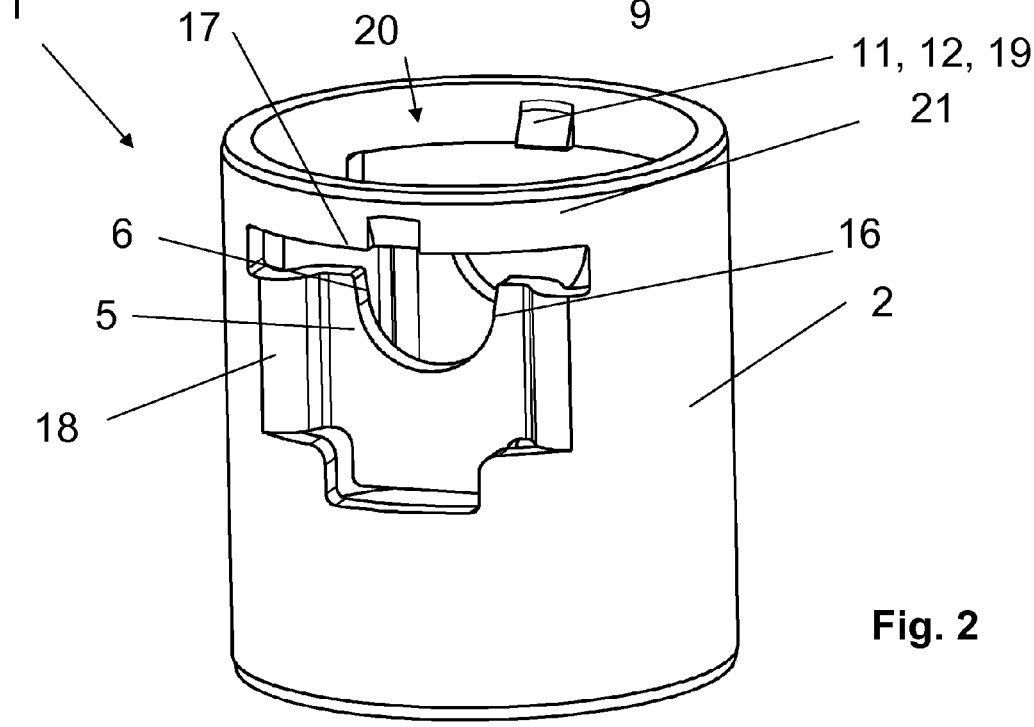
FIG. 2 a three dimensional view of the housing of the roller tappet, rotated relative to the view of FIG. 1.

FIG. 1 discloses a roller tappet 1 a comprising a housing 2 made out of thin-walled sheet steel, in the present case, for a high pressure fuel pump. In the vicinity of a drive side front end 3 of the roller tappet 1 are situated two opposing flats 5 that recede integrally from an outer wall 4 of the housing 2, with each comprising a seat 6 having a U-shape that is open in a direction of the drive side front end 3. A pin 7 is mounted in the seats 6. A roller 8 serving as a run-on surface of a cam or an eccentric extends on the pin via a bearing 24 that is a needle roller bearing or a sliding bearing or a combination of these two.

A support 10 for a pump piston extends near a driven side front end 9 of the roller tappet 1 axially under the roller 8. This support 10 is situated on an underside 23 of a separate bridge member 23 that penetrates through the housing 2.

The invention further provides a simple retention element 11 in the axial direction of the pin 7 and a retention element 12 in the seats 6 of pin 7 for preventing the pin 7 from exiting axially out of the housing 2. These retention elements 11, 12 are united.

The pin 7 comprises a central section 13 of a large diameter that carries the roller 8, through which central section 13, the roller 8 is seated in the seats 6. On each of its ends, the central section 13 comprises a stub-like annular shoulder 14 with a smaller diameter than that of the central section 13. In this way, an annular step 15 is created between the central section 13 and each annular shoulder 14. To be seen at the same time is that lateral arms 16 of the seats 6 are smooth-walled and extend straightly upwards so as to surround the pin 7, at the most over 180°. In the final analysis, this pin 7 lies "loosely" in the seats 6.

Both figures show that a finger 19 projects integrally from an upper transverse side 17 of each window 18 of the housing 2 near the respective flat 5 into the tappet interior 20. The transverse side 17 is part of a smooth-walled closed, continuous ring 21 of the housing 2, which continuous ring 21 possesses an outer diameter that is equal to the diameter of the housing 2 and is an integral part of the housing 2.

The aforesaid finger 19 is slightly stamped and bent inwards. The finger 19 extends directly in front of the annular step 15 on the short annular shoulder 14 of the pin 7. Through this measure, the pin 7 is retained on the one hand with slight lash in its axial direction. On the other hand, the pin 7 is retained from exiting axially out of the housing 2 i.e. in direction towards the drive side end 3 of the housing 2.

LIST OF REFERENCE NUMERALS

1 Roller tappet
2 Housing
3 Front end on drive side
4 Outer wall
5 Flat
6 Seat
7 Pin
8 Roller
9 Front end on driven side
10 Support
11 Retention element
12 Retention element
13 Central section
14 Annular shoulder
15 Annular step
16 Lateral arm
17 Transverse side
18 Window
19 Finger
20 Tappet interior
21 Continuous ring
22 Bridge member
23 Underside
24 Bearing

The invention claimed is:

1. A roller tappet comprising a housing having a drive side front end and two diametrically opposing flats receding from an outer wall of the housing arranged near the drive side front end, each of said two flats comprising a seat with a U-shaped opening that is open in a direction towards the drive side front end, a pin being mounted in said seats, a roller serving as a run-on surface of a periodic stroke producer extending on said pin, a support for a tappet follower element being seated axially under the roller near a driven side end of the roller tappet, and a unified retention element formed on the housing retains the pin in an axial direction of the pin and prevents the pin from exiting out of the housing in a housing axial direction.

2. The roller tappet according to claim 1, wherein, the pin comprises a central section of a large diameter that carries the roller, through which central section the roller is seated in the seats, and further comprises two end annular shoulders of a diameter smaller than that of the central section, so that an annular step is created between the central section and each respective one of the annular shoulders, lateral arms of the seats extending in an axial direction of the tappet are smooth-walled and straight, while at the same time, a finger protrudes from near the corresponding flat into an interior of the tappet from an upper transverse side of a window of the housing so as to run to a point immediately in front of or on the corresponding annular shoulder and the annular step of the pin.

3. The roller tappet according to claim 2, wherein the outer wall of the housing between the upper transverse side of the two windows, which comprise the fingers, and the drive side front end is configured as a smooth-walled, closed continuous ring.

4. The roller tappet according to claim 3, wherein the fingers protrude integrally from the respective transverse sides and extend into the interior of the tappet following an inwardly bent course.

5. The roller tappet according to claim 2, wherein the housing together with the integrally connected flats and the fingers are made out of thin-walled steel sheet.

6. The roller tappet according to claim 2, wherein axially under the roller, the housing is penetrated by a bridge member having an underside that comprises the support for the tappet follower element.

7. The roller tappet according to claim 1, wherein the roller tappet is adapted for use a) in a high pressure fuel pump, b) in a valve train of an internal combustion engine, c) in an engine such as an axial piston engine or a radial piston engine, or d) generally for a pump or compressor of an axial piston type or of a radial piston type.

* * * * *